United States Patent [19]

Karpp

[11] 4,094,037

[45] June 13, 1978

[54] WIPING DEVICE

[76] Inventor: Heinrich Karpp, Fahrenberg 19 A, 4300 Essen 15, Germany

[21] Appl. No.: 744,606

[22] Filed: Nov. 24, 1976

[30] Foreign Application Priority Data

Nov. 26, 1975 Germany ..... 7537550[U]

[51] Int. Cl.[2] ..... A47L 1/06

[52] U.S. Cl. ..... 15/245; 15/250.41

[58] Field of Search ..... 15/250.36–250.42, 15/245

[56] References Cited

U.S. PATENT DOCUMENTS

| | | | |
|---|---|---|---|
| 1,628,783 | 5/1927 | Jensen et al. | 15/245 |
| 1,786,457 | 12/1930 | Sarver | 15/245 |
| 2,225,432 | 12/1940 | Ginsberg | 15/245 |
| 2,261,475 | 11/1941 | Kautenberg | 15/245 |
| 2,852,798 | 9/1958 | Grossfeld | 15/245 |
| 3,638,274 | 2/1972 | Farver | 15/250.41 |
| 3,950,813 | 4/1976 | Buck | 15/245 |

FOREIGN PATENT DOCUMENTS

| | | | |
|---|---|---|---|
| 461,560 | 2/1937 | United Kingdom | 15/250.41 |

*Primary Examiner*—Peter Feldman
*Attorney, Agent, or Firm*—Michael J. Striker

[57] ABSTRACT

A wiping device includes an elongated wiping blade of elastically yieldable material, a handle, and an arrangement for replaceably mounting the blade on the handle, including an elongated mounting member of U-shaped cross-section which is supported on the handle and which bounds an elongated cavity and an elongated slot communicating the cavity with the exterior of the mounting member. The wiping blade has two marginal portions extending longitudinally of the wiping blade and each having a pair of wiping edges. The thickness of each of the marginal portions exceeds that of a central portion, and the width of the cavity exceeds that of the slot so that, when one of the marginal portions is received in the cavity and the other marginal portion can be located exteriorly of the mounting member, the latter is used for wiping and the former prevents extraction of the wiping blade through the slot. The mounting member may have arms which extend to different distances from the bight interconnecting such arms so that each of the arms reinforces the wiping blade against the bending to a different extent. The marginal faces of the wiping blade which face away from one another may be concave to improve the wiping action of the wiping edges.

8 Claims, 1 Drawing Figure

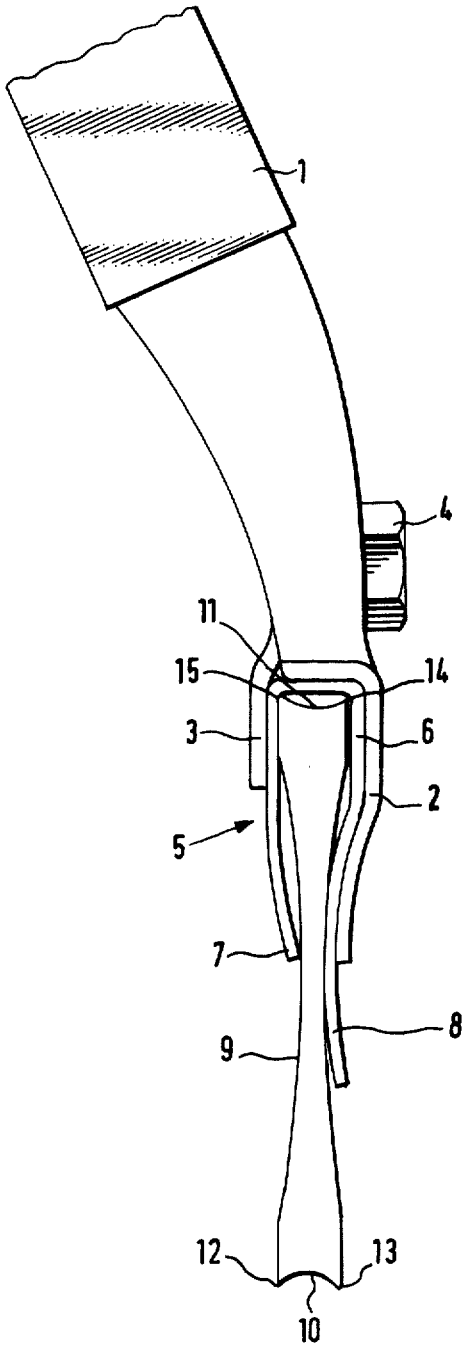
1
4
11
15
14
3
6
2
5
7
8
9
12
13
10

WIPING DEVICE

BACKGROUND OF THE INVENTION

The present invention relates to a wiping device, particularly for cleaning windows and the like.

Many wiping devices are already known, and they are used, among others, also for cleaning window panes, windshields and in similar applications. Usually, such devices include a handle, a mounting member detachably mounted on the handle and having the shape of a profiled rail, and a wiping blade of rubber or similar elastically yieldable material mounted in the mounting member and having a longitudinal marginal portion which extends to the exterior of the mounting member. The wiping blade is usually replaceably supported in the mounting member, so that it can be replaced after becoming worn out, thus avoiding the otherwise existing need for discarding the entire wiping device.

So, for instance, there is already known a wiping device in which the profiled rail which serves as the mounting member for the wiping blade has a formation in the bottom region thereof which is approximately circular in cross-section. The wiper blade which cooperates with this mounting member then has a corresponding bulge at the longitudinal marginal portion thereof which is to be received in the formation. In this conventional device, the profiled rail is of one piece, and the marginal portion which has the bulge is introduced into the formation or cavity in the mounting member through one of the longitudinal ends of the mounting member. Similarly, the worn-out blade can be removed from the mounting member through such longitudinal end to be replaced by a new wiping blade.

However, this conventional device is disadvantageous, in that only that marginal portion of the wiper blade which extends to the exterior of the mounting member can be provided with a front and a rear wiping edge, so that only this marginal portion of the wiper blade can be used for the wiping operation. The other longitudinal marginal portion, as already mentioned before, is already provided with the bulge which cannot be used for wiping purposes. Thus, when both of the above-mentioned wiping edges are worn out, the wiper blade becomes useless and must be discarded. This, of course, results in a relatively high expenditure of material needed for the manufacture of the wiper blade.

SUMMARY OF THE INVENTION

Accordingly, it is a general object of the present invention to avoid the above-mentioned disadvantage.

More particularly, it is an object of the present invention to provide a wiping device which has an extended life as compared to the prior-art wiping devices.

A concomitant object of the present invention is to provide a wiping device which is simple in construction, inexpensive to manufacture and assemble, and reliable in operation.

Still another object of the present invention is to so construct the wiping device that the wiper blade used in connection therewith can be used for a much longer period of time than heretofore known before being replaced.

In pursuance of these objects and others which will become apparent hereafter, one feature of the present invention resides, briefly stated, in a wiping device, particularly for cleaning windows and the like, which comprises an elongated wiping blade having a pair of longitudinal marginal portions and a central portion intermediate the latter; a handle; and means for replaceably mounting said blade on said handle, including wall means bounding an elongated cavity which is open at least at one longitudinal end thereof, and an elongated slot communicating said cavity with the exterior of said wall means along said cavity, said cavity being adapted to receive either one of said marginal portions of said blade whereas said central portion is accomodated in said slot and the other marginal portion extends beyond said wall means to be used for wiping. Each of the marginal portions has a marginal face which faces in the opposite direction than the marginal face of the other marginal portion, and a pair of edges which bound respective marginal face and each of which can be used as a wiping edge. Preferably, the wiping blade is of an elastically yieldable material, such as rubber.

According to a further aspect of the present invention, said wall means includes an elongated mounting member having a U-shaped cross-section, and means for supporting said mounting member on said handle. To advantage, said mounting member has two arms and a bight which interconnects the two arms, one of the arms being longer than the other so that said arms which straddle said one marginal portion contact said central portion up to different distances from said bight, thereby reinforcing said blade to different extents against bending transversely of the blade in opposite directions. The mounting member may be resiliently yieldable.

In a currently preferred embodiment of the present invention, the marginal portions are of thicknesses which exceed that of the central portion, and the above-mentioned slot has a width which is smaller than that of said cavity, so that said one marginal portion is prevented from being extracted from said cavity through said slot. The supporting means may include at least two clamping members mounted on said handle and embracing said mounting member so as to clamp the same between themselves.

When the mounting member and the wiping blade are constructed in the above-mentioned manner, the lifespan of the wiping blade is, for all intents and purposes, doubled in that now both of the marginal portions can be provided with wiping edges so that the wiping blade now has four wiping edges, two at each marginal face, that is, twice as many as previously known.

The insertion or the removal of the wiping blade is performed in a conventional manner through a longitudinal end portion of the mounting member onto which the cavity and the slot open. Inasmuch as the width of the slot is smaller than the thickness of the marginal portion received in the cavity, the wiping blade cannot be extracted from the mounting member by pulling the same in the forward direction.

According to a further aspect of the present invention, the above-mentioned marginal faces are each concave between the respective two edges thereof so that the wiping edges become sharp. In other words, the flanks which meet at the respective wiping edge enclose an acute angle with one another, whereby the wiping action of the wiping edge is improved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The sole FIGURE of the drawing is a side elevational view of the wiping device of the present invention.

DESCRIPTION OF THE PREFERRED EMBODIMENTS

Referring now to the drawing in detail, it may be seen that reference numeral 1 indicates a handgrip or handle. The handle 1 has a projecting shoulder 2 and a shorter shoulder 3 which is dismountably connected to the handle 1 by means of a screw 4 or a similar connecting element.

A mounting member designated in toto by the reference numeral 5 has the shape of a profiled rail, as illustrated, a U-shaped rail. The rail has a bight 6, and two arms 7 and 8 which extend parallel to one another along the mounting member 5 and converge toward one another in direction toward their free ends. The shoulders 2, 3 have such a configuration as to be compatible with or complementary to the profiled rail 5 so that the latter is clamped between the shoulders 2 and 3.

The arms 7, 8 are of different dimensions, that is, the arm 8 extends to a greater distance from the bight 6 than the arm 7. Thus, the arms 7, 8 reinforce a wiper blade 9 located between the arms 7, 8, to different extents against bending in opposite directions.

The wiper blade 9 is of an elastically yieldable material, such as rubber, and is introduced into the mounting member 5 through one of the longitudinal ends of the mounting member 5.

The wiper blade 9 has two marginal faces 10, 11 which extend longitudinally of the wiper blade 9 and face away from one another. The wiper blade 9 also has a longitudinal central portion, and two marginal portions which extend between the central portion and the respective marginal faces 10, 11. Two pairs of wiping edges 12, 13 and 14, 15 are provided at the respective marginal faces 10, 11. As seen in the drawing, one of the marginal portions is received in the cavity bounded by the arms 7, 8 and the bight 6 of the mounting member 5, so that the wiping edges thereof (14, 15 in the illustrated position) are protected. The central portion of the wiper blade 9 has a smaller thickness than either of the marginal portions thereof and the wiper blade 9 tapers from adjacent the marginal portions toward the central portion. Correspondingly, the width of the slot defined between the free end of the arm 7 and the arm 8 is smaller than the width of the cavity and the thickness of the marginal portion which is received in the cavity, so that the wiper blade 9 cannot be extracted from the mounting member 5 through such slot, that is, downwardly in the position illustrated in the drawing.

In the illustrated position of the wiper blade 9 the wiping edge 12 will be worn out first. When this happens, the wiper blade 9 is removed from the mounting member 5 through one of the longitudinal ends thereof and is rotated through 180° about its transverse axis, whereupon it is introduced into the cavity of the mounting member 5. Thus, the wiping edge 13 assumes the forward position and will be subjected to wear during the use of the wiping device. When even the wiping edge 13 is worn out, the wiper blade 9 is again removed from the mounting member 5 and rotated through 180° about its longitudinal axis to be subsequently reintroduced into the cavity of the mounting member 5. Now it is the marginal portion whose wiping edges 12 and 13 have already been worn out which is accomodated in the cavity of the mounting member 5, whereas the wiping edges 14 and 15 are now exposed and project, together with the marginal face 11 outwardly of the mounting member 5. Now, these wiping edges 14 and 15 can be used in a similar manner as previously discussed in connection with the wiping edges 12 and 13.

Experience has shown that it is very advantageous when the flanks which meet at the respective wiping edges 12, 13, 14 and/or 15 enclose an acute angle with one another, which greatly facilitates and enhances the wiping process. Thus, it is further proposed by the present invention to give concave configurations to the marginal faces 10, 11 of the wiper blade 9.

It will be understood that each of the elements described above, or two or more together, may also find a useful application in other types of constructions differing from the types described above.

While the invention has been illustrated and described as embodied in a wiping device, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of generic or specific aspects of this invention.

What is claimed as new and desired to be protected by Letters Patent is set forth in the appended claims:

1. A wiping device, particularly for cleaning windows and the like, comprising an elongated wiping blade having a pair of longitudinal marginal portions each having a pair of edges bounding a respective marginal face and spaced a predetermined distance from one another, and a central portion intermediate said marginal portions, said wiping blade having a thickness at said central portion which is smaller than said distance, and said wiping blade tapering in a direction from adjacent each of said marginal faces toward said central portion; a handle; and means for replaceably mounting said blade on said handle in four different orientations in each of which one of said edges is in a working position for use as a wiping edge, including wall means bounding an elongated cavity which is open at least at one longitudinal end thereof, and an elongated slot communicating said cavity with the exterior of said wall means along said cavity, said cavity being adapted to receive either one of said marginal portions of said blade whereas said central portion is accommodated in said slot and the other marginal portion extends beyond said wall means to the exterior thereof for said one edge thereof to be used for wiping.

2. A wiping device, particularly for cleaning windows and the like, comprising an elongated wiping blade having a pair of longitudinal marginal portions each having a pair of edges spaced a predetermined distance from one another bounding a respective marginal face which is concave between the respective pair of edges, said wiping blade further having a central portion intermediate said marginal portions, said wiping blade having a thickness which is smaller than said distance at said central position, and said wiping blade tapering in a direction from adjacent each of said marginal faces toward said central portion; a handle; and means for replaceably mounting said blade on said handle in four different orientations in each of which one of said edges is in a working position for use as a wiping edge, including wall means bounding an elongated cavity which is open at least at one longitudinal end thereof, and an elongated slot communicating said cavity with the exterior of said wall means along said cavity, said cavity being adapted to receive either one of said marginal portions of said blade whereas said central portion is accommodated in said slot and the other marginal portion extends beyond said wall means to the exterior thereof for said one edge thereof to be used for wiping.

3. A device as defined in claim 1, wherein said blade is of an elastically yieldable material.

4. A device as defined in claim 1, wherein said wall means includes an elongated mounting member having a U-shaped cross-section, and means for supporting said mounting member on said handle.

5. A device as defined in claim 4, wherein said mounting member has two arms and a bight interconnecting said two arms, one of said arms being longer than the other so that said arms which straddle said one marginal portion contact said central portion up to different distances from said bight, thereby reinforcing said blade to different extents against bending transversely of the blade in opposite directions.

6. A device as defined in claim 4, wherein said mounting member is resiliently yieldable.

7. A device as defined in claim 4, wherein said marginal portions diverge from that of said central portion; and wherein said slot has a width which is smaller than that of said cavity, so that said one marginal portion is prevented from being extracted from said cavity through said slot.

8. A device as defined in claim 4, wherein said supporting means includes at least two clamping members mounted on said handle and embracing said mounting member so as to clamp the same between themselves.

* * * * *